United States Patent [19]

Moon

[11] Patent Number: 4,554,800

[45] Date of Patent: Nov. 26, 1985

[54] JEWELRY ARRANGEMENT

[76] Inventor: Richard D. Moon, 2419 Fallen Dr., Rowland Heights, Calif. 91748

[21] Appl. No.: 548,353

[22] Filed: Nov. 3, 1983

[51] Int. Cl.[4] ..... A44C 25/00; A44C 7/00

[52] U.S. Cl. ..... 63/23; 63/13

[58] Field of Search ..... 63/14 R, 14 G, 12, 2, 63/26, 27, 28, 23, 4, 13; 24/265 R; 428/28, 52

[56] References Cited

U.S. PATENT DOCUMENTS

| | | | |
|---|---|---|---|
| 292,810 | 2/1884 | Hartmann | 63/13 |
| 1,074,673 | 10/1913 | Weiss | 63/26 X |
| 2,499,592 | 3/1950 | Kramer | 63/4 |
| 2,586,758 | 2/1952 | Zerr | 63/20 |

FOREIGN PATENT DOCUMENTS

| | | | |
|---|---|---|---|
| 558284 | 5/1923 | France | 63/2 |
| 653960 | 11/1928 | France | 63/13 |

*Primary Examiner*—F. Barry Shay

*Attorney, Agent, or Firm*—Don B. Finkelstein

[57] ABSTRACT

A jewelry arrangement particularly adapted to earrings. A base means 12 has a back plate 16 and an upstanding side wall 18 defining a link receiving cavity 20. A chain-like jewelry member 14 has an end link 32 positioned in the link receiving cavity 20 of the base means 12, and an adhesive is utilized to bond the end link 32 of the chain-like jewelry member 14 in the cavity 20 to the base means 12.

13 Claims, 22 Drawing Figures

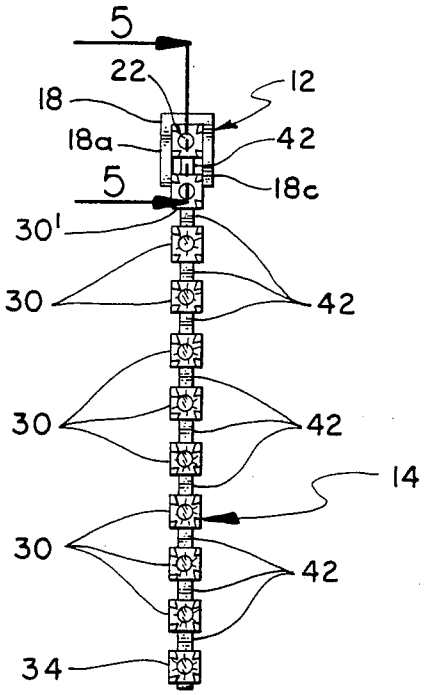
FIG. 1
FIG. 2
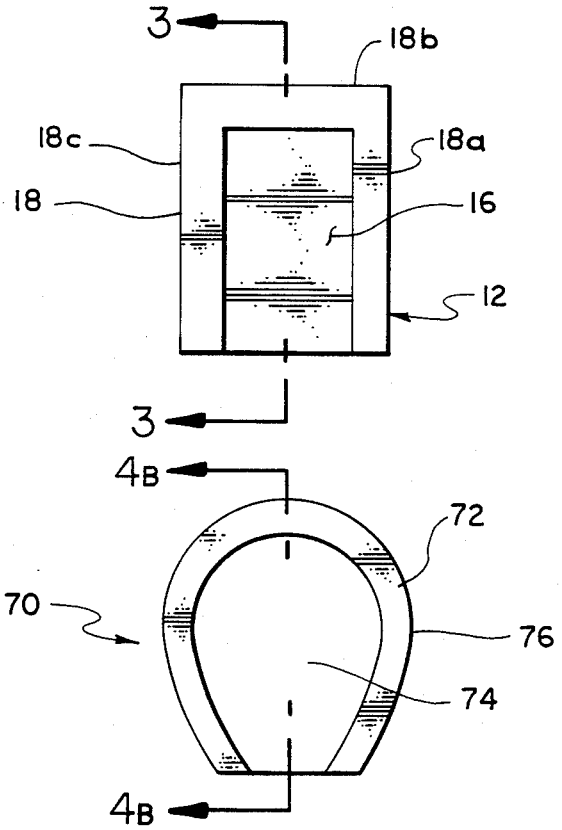
FIG. 3
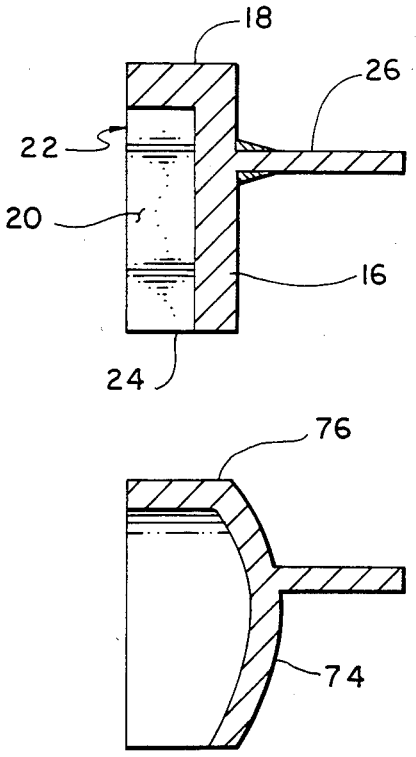
FIG. 4A
FIG. 4B

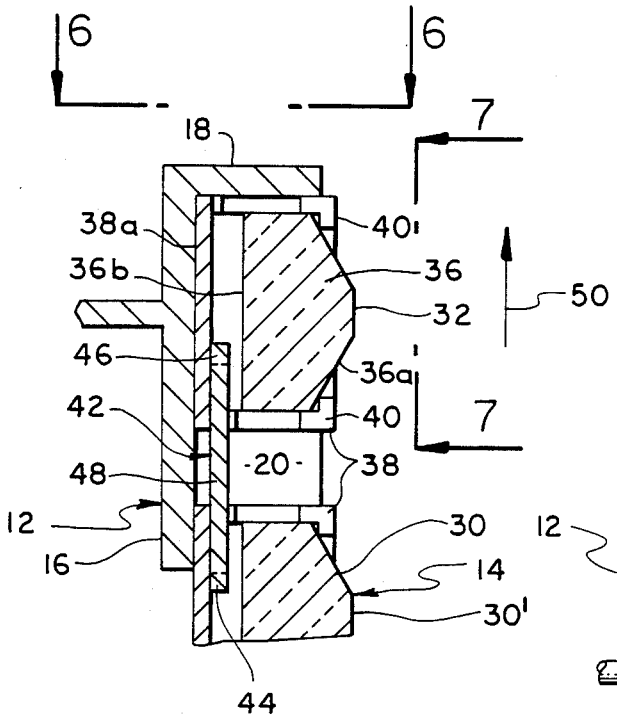
FIG. 5
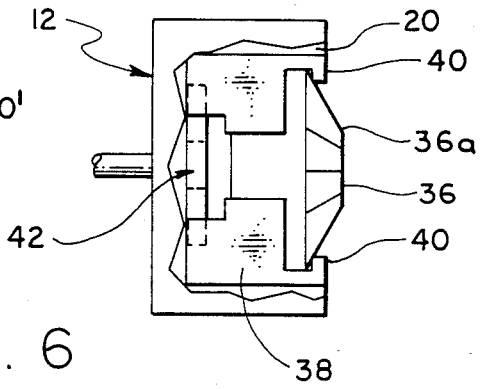
FIG. 6
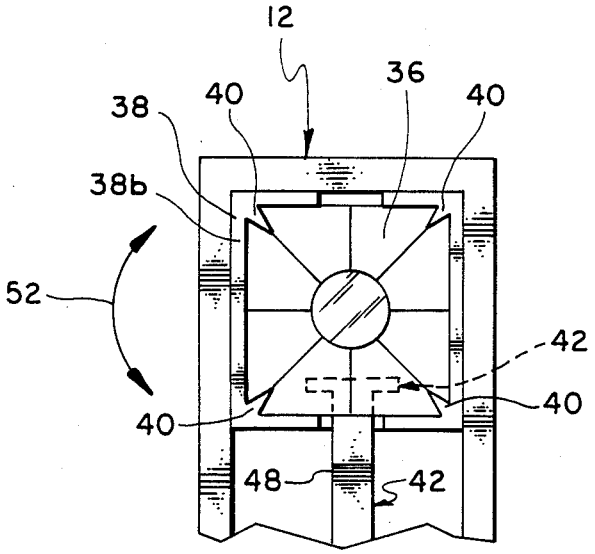
FIG. 7
FIG. 8
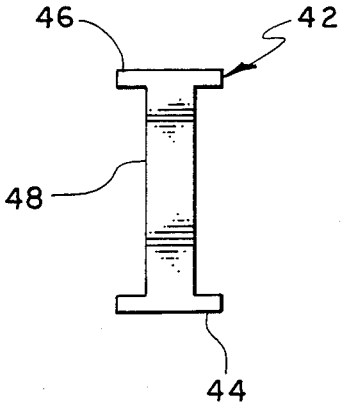

JEWELRY ARRANGEMENT

BACKGROUND OF THE INVENTION

This invention relates to the jewelry art, and, more particularly, to an improved jewelry arrangement particularly adapted to earrings.

DESCRIPTION OF THE PRIOR ART

Articles of adornment for people have long been utilized. Even the very earliest cultures and societies utilized various types of articles, including bones, stones, wood, and the like, attached to or placed on the body, as articles of adornment. Such articles of adornment are generally now termed jewelry.

While, of course, expensive jewelry utilizing precious stones and metals are available to those who are able to afford the cost thereof, there also exists a large market for "fashion" jewelry, that is, comparatively inexpensive jewelry, used in various articles of adornment.

One type of fashion jewelry is earrings. Since earrings are either clipped to the ears or mounted on the ears through holes in the earlobes, earrings are, preferably, comparatively light weight, so as not to cause discomfort to the wearer. That is, the heavier the weight of earrings, the more secure must be the retention of the earrings on the ears. Consequently, the heavier earrings cause a greater load and, consequently, in many instances, greater discomfort to the wearer of the earrings.

Additionally, in fabricating fashion jewelry, cost must also be considered, since fashion jewelry is, in general, designed to sell at comparatively low cost to enable large numbers of people to enjoy attractive jewelry items. Thus, it is desired in fashion jewelry to have a fabrication thereof in such form that the basic components may be utilized in a variety of forms to provide a variety of appearances of such jewelry, be economical to fabricate, and yet still be adaptable to mass fabrication techniques.

Prior art jewelry, and, in particular, prior art fashion jewelry earrings have not proved satisfactory in providing the above desiderata.

SUMMARY OF THE INVENTION

Accordingly, it is an object of the present invention to provide an improved jewelry arrangement.

It is another object of the present invention to provide an improved jewelry arrangement particularly adaptable to earrings.

It is another object of the present invention to provide an improved jewelry arrangement which can be fabricated at comparatively low cost and be comparatively light weight.

It is yet another object of the present invention to provide an improved jewelry arrangement which has a highly attractive appearance and may be fabricated into a variety of different forms.

In the description of the invention herein, the jewelry selected for illustration according to the principles of the present invention, are earrings. However, it will be appreciated that the principles of the invention may be utilized in many other forms of jewelry, such as brooches, rings, or the like. Accordingly, while the invention is illustrated as adapted particularly to earrings, those skilled in the art will readily see that the principles thereof may be adapted to many other forms and types of jewelry.

The above and other objects of the present invention are achieved, according to a preferred embodiment thereof, by providing a base means which has a back plate means and side wall means upstanding from the back place means. The side wall means preferably extend at substantially right angles from the back plate means and, together with the back plate means, define a link receiving cavity. The back plate means may be planar, may be doubly curved, or dish-shaped, or any other desired geometric configuration. Similarly, the side wall means may be rectilinear, to define, for example, a U-shape or may be arcuate. To provide light weight, the back plate and side wall of the base means may, for example, be metal on the order of one 32nd of an inch thick. The link receiving cavity defined by the side wall means and the back plate means of the base means has an open front and one open end. For example, in the preferred embodiment of the present invention, wherein the side wall means is rectilinear, and defines a U-shape, the open end of the U provides the open end, and the side opposite the base plate is open.

A chain-like jewelry member, having a plurality of jewelry links joined together by a plurality of joining members, in which the links are preferably movably mounted on the joining members to provide limited relative motion therebetween, is utilized to provide an ornamental configuration of the present invention. Each link may be comprised of a gem simulating portion, such as glass, faceted to resemble a diamond, and a comparatively thin metal shell to which the glass is coupled. Such forms of chain-like jewelry members are well known in the art and are readily available to artisans and jewelry manufacturers, and, consequently, the chain-like jewelry member does not, in and of itself, form a part of the present invention.

The chain-like jewelry member has an end link which is positioned in the link receiving cavity of the base means. In order to secure the chain-like jewelry member to the base means, a suitable adhesive is applied between the walls of the link receiving cavity and the metal shell of the end link of the chain-like jewelry member, to provide the bonding necessary to couple the chain-like jewelry member to the base means.

The chain-like jewelry member may, accordingly, be cut to any desired length to provide the desired appearance for the earring.

In other embodiments of the present invention, the side wall means and back plate means of the base means may define a plurality of link receiving cavities which may be aligned in any desired fashion such as linear arrays, stepped arrays, symmetrical stepped arrays, or the like. In such embodiments, if desired, the remote end link of the chain-like jewelry member may be brought around and bonded by the adhesive into one of the other of the plurality of link receiving cavities to define a loop like configuration for the chain like-jewelry member.

BRIEF DESCRIPTION OF THE DRAWING

The above and other embodiments of the present invention may be more fully understood from the following detailed description, wherein similar reference characters refer to similar elements throughout and in which:

FIG. 1 illustrates a preferred embodiment of the present invention;

FIG. 2 illustrates a base means useful in the practice of the present invention;

FIG. 3 is a sectional view along the line 3—3 of FIG. 2;

FIG. 4A and FIG. 4B illustrate another base means useful in the practice of the present invention;

FIG. 5 is a sectional view along the line 5—5 of FIG. 1;

FIG. 6 is a view along the view line 6—6 of FIG. 5;

FIG. 7 is a view along the view line 7—7 of FIG. 5;

FIG. 8 illustrates a joining member of the chain-like jewelry member, useful in the practice of the present invention;

DESCRIPTION OF THE PREFERRED EMBODIMENTS

Figure 9:
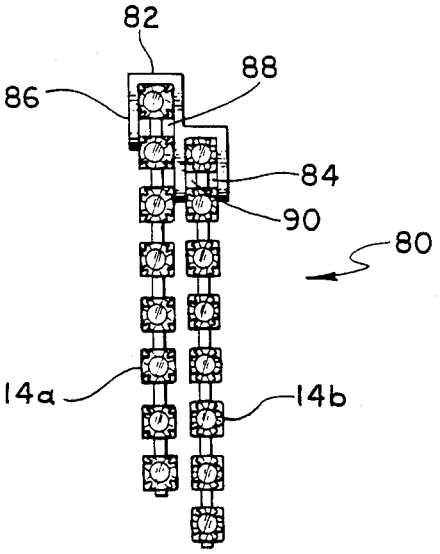
FIG. 9 illustrates another embodiment of the present invention.

Referring now to the drawing, there is illustrated in FIG. 1, an embodiment generally designated 10, of the present invention. In the embodiment 10, there is provided a base means 12 and a chain-like jewelry member 14. The base means 12, as more fully illustrated in FIGS. 2 and 3, is comprised of back plate means 16 and a side wall means 18, upstanding from the back plate 16. In preferred embodiments of the present invention, the side wall means 18 extends at substantially right angles from the back plate means 16. In the embodiment 10 illustrated in FIGS. 1, 2, and 3, the side wall means 18 has three side wall portions, 18*a*, 18*b*, and 18*c*, which, together with the back plate means 16 define a link receiving cavity 20. As illustrated, the link receiving cavity has an open front, as illustrated as 22, and an open end, as illustrated at 24. The three side wall portions 18*a*, 18*b*, and 18*c*, are rectilinear and planar in the embodiment 10. Similarly, the back plate means 16 is planar. As described below in greater detail, both the side wall means 18 and the back plate means 16, may be in any desired geometric configuration.

As noted above, the present invention is described as utilized in an earring, and, in particular, for utilization in ears which are pierced. Consequently, an ear attachment means 26 is coupled to the back plate 16 and extends therefrom in a direction opposite to the direction of the upstanding side wall means 18. When inserted in the pierced ear, a suitable clip (not shown) may be utilized on the ear attachment means 26, to retain the embodiment 10 in the ear.

As noted above, the chain-like jewelry member 14 does not, per se, form a part of the present invention. However, to aid in the full understanding and appreciation of the present invention, the chain-like jewelry member 14 is illustrated in FIGS. 5, 6, 7, and 8. As illustrated therein, the chain-like jewelry member has a plurality of links 30, and, in the embodiment 10, also comprises a first end link 32, and a second end link 34. The first end link 32 and second end link 34 may be identical to the links 30. Each of the links of the chain-like jewelry member has a jewel member 36, which, for example, may be glass or similar material, faceted on the upper surface 36*a* to resemble a diamond or other precious stone. A box like or shell structure 38 is provided and retains the jewelry member therein. The jewel member 36 may be retained in the box like or shell structure 38 by the corner tabs 40. Joining members 42 are utilized to connect the links 30, 32, and 34, and each of the joining members 42 is identical. FIG. 8 illustrates the joining member 42, and, as shown, the joining member 42 has an "I" configuration in plan view, with the two end plates 44 and 46 and the central portion 48. The central portion 48 extends between the links and the ends 46 and 44 are retained within the box like structure 38 between a base portion 38*a* thereof, and a bottom surface 36*b*, of the jewelry member 36, which is spaced from the base portion 38*a*. The joining members 42, therefore, may have relative movement with the links 30, 32, and 34 in both the directions indicated by the double ended arrow 50, which are in linear directions along the length of the chain like jewelry member 40, as well as limited relative rotational movement in the directions indicated by the double ended curved arrow 52.

The thickness of the walls of the box like or shell structure 38 is comparatively thin, on the order of a few thousandths of an inch.

According to the principles of the present invention, in the embodiment 10, the first end link 32 is coupled, for example, bonded, to the base means 12 by a suitable adhesive applied between the inner surfaces of the back plate means 16 and side wall means 18, and the box like or shell structure 38 of the first end link 32. It has been found that, for example, the new "super" adhesives, such as the cyanoacrylic adhesives are satisfactory for this application. However, other adhesives may also be utilized. By utilizing an adhesive, rather than mechanical connection or welding, soldering, brazing, or the like, of the chain-like jewelry member 14 and the base means 12, a considerable weight saving is realized and comparatively thin walled, light weight structures may be incorporated. Further, the chain-like jewelry member which is fabricated in any desired length, may be conveniently cut to any length required for particular jewelry applications by severing the joining members 42 between any two adjacent links.

As shown more clearly in FIGS. 5, 6, and 7, the box like or shell structure means 38, in addition to a link back plate 38*a* has a link side wall 38*b* defining the box like or shell structure 38. The link side wall 38*b* is adjacent the side wall means 16 of the base means 12, and preferably has the same geometric configuration. That is, in the embodiment 10, the geometric configuration of the side wall means 16 of the base means 12 is rectilinear, and, correspondingly, the box like or shell structure 38 of the first end link 32 also has the link side wall 38*b* in a matching or rectilinear geometric configuration. Similarly, the link back plate 38*a* has the same geometric configuration as the back plate means 16 of the base means 12, which, in the embodiment 10, is planar.

FIGS. 4*a* and 4*b* illustrate another embodiment, generally designated 70, of a base means 72, having a back plate means 74, and a side wall means 76, upstanding therefrom, substantially at right angles thereto. In the embodiment 70, however, the back plate means 74 is double curved or "dished" and the side wall means 76 is arcuate. In embodiments of the present invention utilizing the base means 72 of embodiment 70, it is preferred that at least the end link of a chain-like jewelry member, which may be similar to the chain-like jewelry member 14 be constructed so that the link back plate is also double curved, or dished, to match the curvature of the back plate means 74, and the link side wall be arcuate, to match the curvature of the side wall means 76. Such chain-like jewelry members are also well known in the art, and those skilled in the art will readily understand, from the above description of FIGS. 5, 6, 7, and 8, the detailed structural configuration of such a chain-like jewelry member which may be appropriately utilized as above set forth in the embodiment 70.

In the embodiment 10, as shown on FIG. 1, in preferred embodiments of the present invention, the side wall portions 18*a* and 18*c* and back plate means 16 extend to regions adjacent the next adjacent or successive link 30' to the first end link 32, although such successive link 30' need not, if so desired, be bonded by adhesive to the base means 12.

The dimension of the base means 12 may be on the order of $\frac{1}{4}$ inch wide along side wall portion 18*b* and $\frac{1}{4}$ to $\frac{3}{8}$ inch long along side wall portions 18*a* and 18*b*.

Referring now to FIG. 9, there is illustrated another embodiment, generally designated 80, of the present embodiment, generally designated 80, of the present invention, which has a base means 82, generally similar to the base means 12, except that in the embodiment 80 the back plate 84 of the base means 82, together with the side wall means 86 of the base means 84, define two link receiving cavities 88 and 90, which may be similar to the link receiving cavity 20. First and second chain-like jewelry members 14*a* and 14*b*, respectively, may be coupled into the link receiving cavities 88 and 90 of the base means 82 by suitable adhesive, as above described. The particular configuration of the link receiving cavities 88 and 90 of the embodiment 80 may be termed a staggered relationship and, in particular, a step-staggered relationship. The chain-like jewelry members 14*a* and 14*b* may be identical to the chain-like jewelry member 14 of FIG. 1. While in the embodiment 80 shown in FIG. 9, the actual length of each of the chain-like jewelry members 14*a* and 14*b* is the same, the step staggered relationship of the link receiving cavities 88 and 90 give an appearance of greater length to chain-like jewelry member 14*b*. However, it will be appreciated that the length of the chain-like jewelry members 14*a* and 14*b* may be selected as desired.

Figure 10:
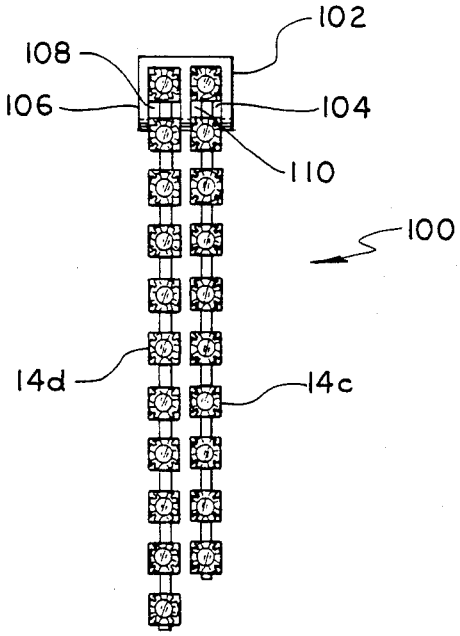
FIG. 10 illustrates another embodiment of the present invention.

FIG. 10 illustrates another embodiment of the present invention, generally designated 100, in which there is provided a base means 102, which is generally similar to the base means 12, illustrated in FIG. 1, and the base means 82, illustrated in FIG. 9, except that the back plate means 104, together with the upstanding side wall means 106 of the base means 102, define a pair of link receiving cavities 108 and 110, which are in aligned relationship. Each of the cavities 108 and 110 may be the same as the link receiving cavity 20, illustrated in FIGS. 1, 2, and 3. The embodiment 100 may be completed by addition of first and second chain-like jewelry members 14*c* and 14*b*, which may be similar to chain-like jewelry member 14, and which are respectively coupled onto the link receiving cavities 108 and 110 by bonding by means of a suitable adhesive, as above described. In the embodiment 100, the first chain-like jewelry member 14*b* has a different length than the second chain-like jewelry member 14*c*. However, as noted above, the chain-like jewelry members may be cut to any desired length.

Further, it will be appreciated, the base means utilized in any of the embodiments of the present invention may be in the form illustrated in FIGS. 4*a* and 4*B*. That is, in each of the embodiments described herein, instead of having a planar back plate means, and rectilinear side wall means, the base means may be provided with a doubly curved back plate means and an arcuate side wall means. The chain-like jewelry members utilized in such embodiments may have correspondingly geometrically configured surfaces for coupling by bonding thereto.

Figure 11:
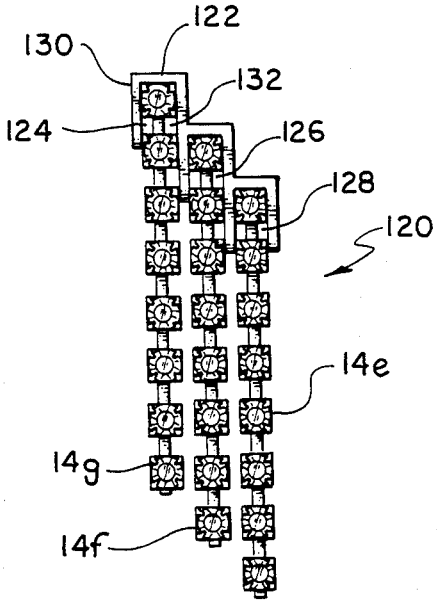
FIG. 11 illustrates another embodiment of the present invention.

FIG. 11 illustrates another embodiment of the present invention, generally designated 120, wherein the base means 122 thereof provides a plurality of three link receiving cavities 124, 126, and 128, defined by the side wall means 130 and back plate means 132 thereof. Each of the link receiving cavities 124, 126, and 128, may be similar to the link receiving cavity 20 described in connection with FIGS. 1, 2, and 3.

Chain-like jewelry members 14*e*, 14*f*, and 14*g*, which may be identical to the chain-like jewelry member 14, described in connection with FIG. 1, may have their end links appropriately bonded by adhesive into one of the link receiving cavities 124, 126, and 128, of the base means 122. The particular relationship of the three link receiving cavities, 124, 126, and 128, is a staggered step relationship.

Figure 12A:
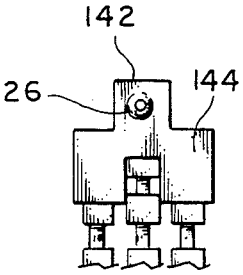
FIG. 12 and 12A illustrate another embodiment of the present invention.
Figure 12:
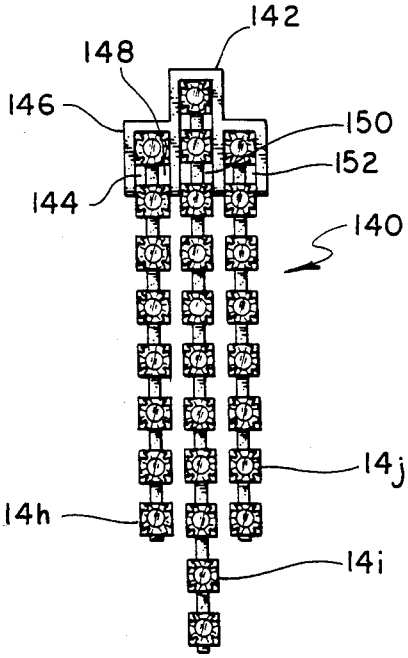

FIG. 12 illustrates another embodiment of the present invention, generally designated 140, in which a base means 142 has a back plate means 144 and side wall means 146, which define three link receiving cavities 148, 150, and 152, which are in a symmetrical staggered relationship to each other. Each of the link receiving cavities, 148, 150, and 152, may be substantially identical to the link receiving cavity 20, described in connection with FIGS. 1, 2, and 3. That is, the back plate 144 need not extend fully between the side wall portions defining the link receiving cavities 148 and 152. In preferred embodiments of the present invention, this is done to save weight and cost in the fabrication of jewelry according to the principles of the present invention.

Chain-like jewelry members 14*h*, 14*i*, and 14*j*, may have their end links respectively bonded by a suitable adhesive, as above described into the link receiving cavities 148, 150, and 152.

Thus, the chain-like jewelry members 14*a*, 14*i*, and 14*j* may be substantially identical to the chain-like jewelry member 14, described above in connection with FIGS. 1, 2, and 3.

FIG. 12*a* illustrates a rear view of the base means 142 of the embodiment 140, and shows how the back plate means 144 thereof is "cut-out" to save weight and provide the uniformity of the link receiving cavities described above.

Figure 13:
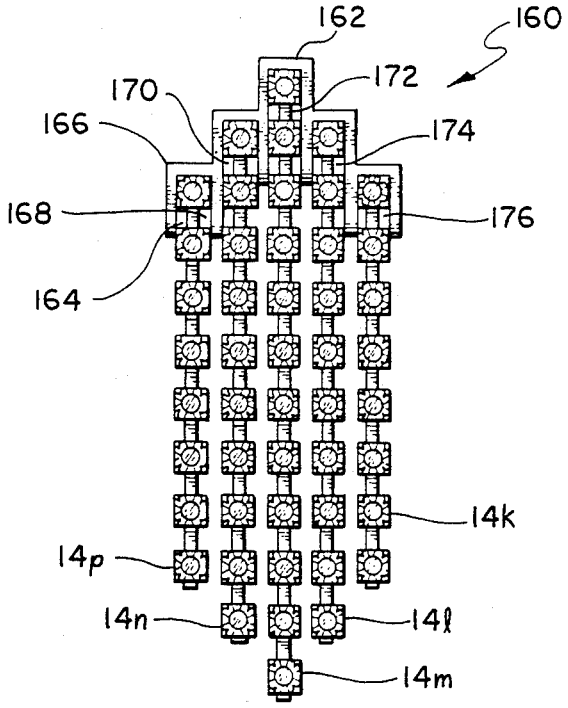
FIG. 13 and 13A illustrate another embodiment of the present invention.
Figure 13A:
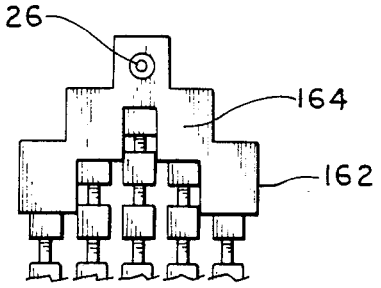

Referring now to FIG. 13, there is illustrated another embodiment of the present invention, generally designated 160, in which a base means 162 is provided having a back plate means 164, and side wall means 166, defining a plurality of five link receiving cavities 168, 170, 172, 174, and 176. In the embodiment 160, the plurality of link receiving cavities are arranged in symmetrical staggered relationship, and each of the plurality of link receiving cavities 168, 170, 172, 174, and 176, are substantially identical to link receiving cavity 20, described above in connection with FIGS. 1, 2, and 3. A plurality of five chain-like jewelry members 14*k*, 14*l*, 14*m*, 14*n*, and 14*p*, have their end links bonded by an adhesive into one of the link receiving cavities. FIG. 13*a* is a rear view of the embodiment 160, and illustrates how the back plate 164, of the base means 162, is configured to provide the substantial identity of each of the link receiving cavities 168, 170, 172, 174, and 176, to the link receiving cavity 20 illustrated in FIGS. 1, 2, and 3.

Figure 14:
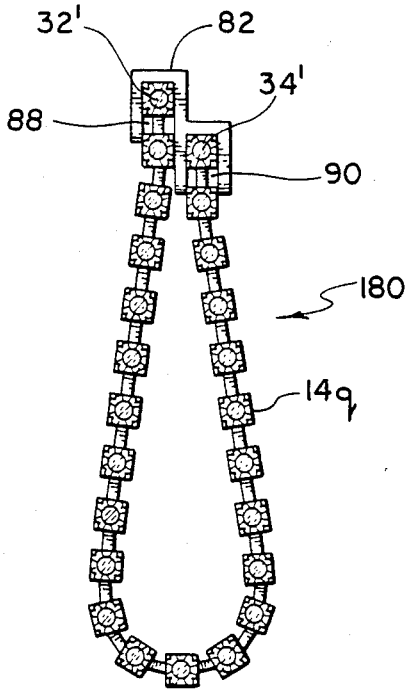
FIG. 14 illustrates another embodiment of the present invention.

FIG. 14 illustrates another embodiment of the present invention, generally designated 180, in which there is provided a base means 182, substantially identical to the base means 82, illustrated in FIG. 9, and in which a chain-like jewelry member 14*q* is provided, which is substantially identical to the chain-like jewelry member 14, described in connection with FIGS. 1, 5, 6, 7, and 8, and in which the first end link 32' thereof is bonded by a suitable adhesive in the first link receiving cavity 88, and the second end link 34' is bonded by a suitable adhesive in the second link receiving cavity 90, thus forming a "loop" like structure for the chain-like jewelry member 14*q*. As noted above, of course, the end links 32' and 34' are identical, and are identical to the end link 32 illustrated in FIGS. 1, 5, 6, 7, and 8.

Figure 15:
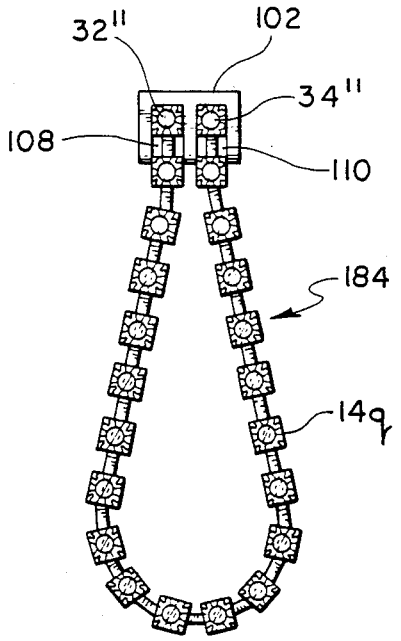
FIG. 15 illustrates another embodiment of the present invention.

FIG. 15 illustrates another embodiment of the present invention, generally designated 184, which is provided with the base means 102, identical to the base means 102 illustrated in FIG. 10, and in which a chain-like jewelry member 14*q*, identical to the chain-like jewelry member 14*q* described in connection with FIG. 14, is utilized, and in which the end links 32" and 34" are coupled, respectively, into the link receiving cavities 108 and 110, of the base means 102 to form the loop like structure. Thus, in the embodiment 184 of FIG. 15, the link receiving cavities 108 and 110 are in an aligned relationship and in the embodiment 180 of FIG. 14, the link receiving cavities are in a step-staggered relationship.

Figure 16:
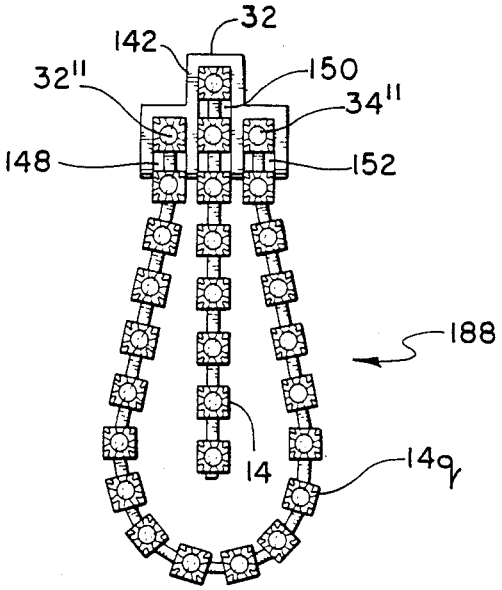
FIG. 16 illustrates another embodiment of the present invention.

FIG. 16 illustrates an embodiment of the present invention generally designated 188, in which there is provided the base means 142, identical to the base means 142 illustrated in FIG. 12, and which is provided with a first chain-like jewelry member 14*q*, identical to the chain-like jewelry member 14*q* illustrated in FIG. 15, and which has end links 32" and 34" coupled by bonding with a suitable adhesive into link receiving cavities 148 and 152, respectively, and a second chain-like jewelry member 14, identical to the chain like jewelry member 14 illustrated in FIG. 1, having its end link 32 coupled in the link receiving cavity 150, by bonding thereto with a suitable adhesive.

Figure 17:
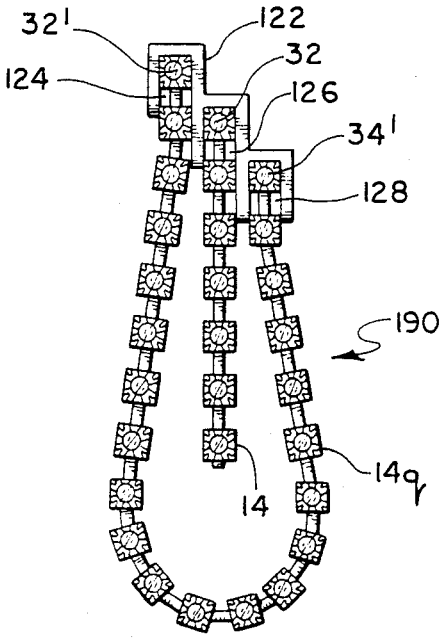
FIG. 17 illustrates another embodiment of the present invention.

FIG. 17 illustrates another embodiment of the present invention, generally designated 190, which is provided with a base means 122, identical to the base means 122 illustrated in FIG. 11, and having a first chain-like jewelry member 14*q*, identical to the chain-like jewelry member 14*q* described in connection with FIG. 14, having its end links 32' and 34' bonded by a suitable adhesive in link receiving cavities 124 and 128, to define a loop like configuration. A second chain-like jewelry member 14, has its end link 32 bonded by a suitable adhesive in the link receiving cavity 126 and the chain-like jewelry member 14 may be identical to the chain-like jewelry member 14 described in connection with FIGS. 1, 2, and 3.

Figure 18:
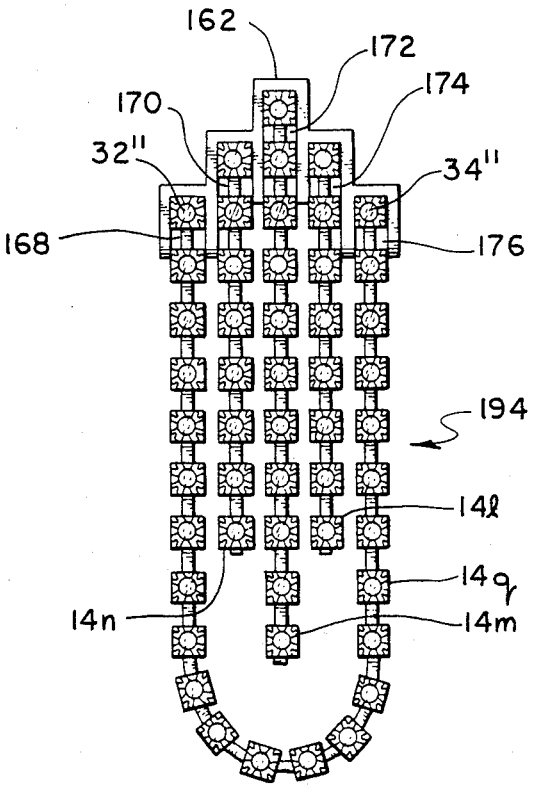
FIG. 18 illustrates another embodiment of the present invention.

FIG. 18 illustrates another embodiment of the present invention, generally designated 194, in which there is provided a base means 162, identical to the base means 162 described above in connection with FIG. 13, and in which there is provided a first chain-like jewelry member 14*q*, substantially identical to the chain-like jewelry member 14*q* illustrated in FIG. 16, having its end links 32" and 34" respectively coupled into link receiving cavities 168 and 176, and second, third, and fourth chain-like jewelry members 14*l*, 14*m*, and 14*n*, which may be identical to the chain-like jewelry members 14*l*, 14*m*, and 14*n* described above in connection with FIG. 13, which have their end links respectively bonded by a suitable adhesive in link receiving cavities 170, 172, and 174.

Figure 19:
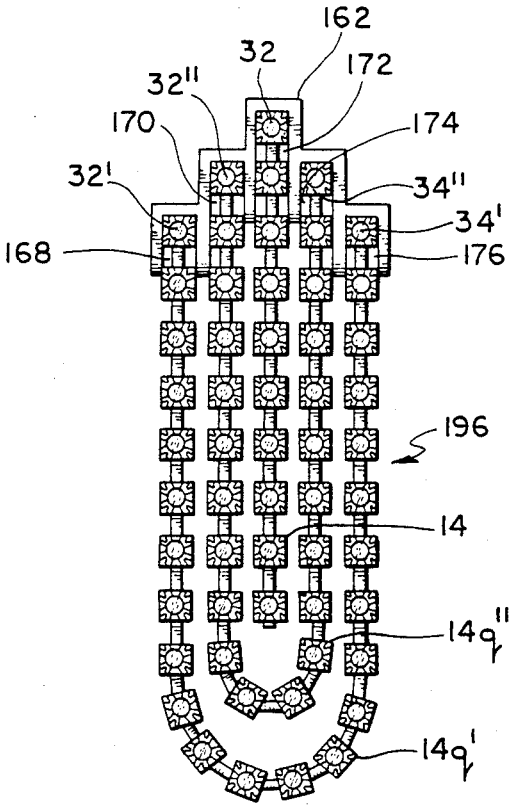
FIG. 19 illustrates another embodiment of the present invention.

FIG. 19 illustrates yet another embodiment of the present invention, generally designated 196, which is provided with a base means 162, identical to the base means 162 described above in connection with FIGS. 13 and 18, and which is provided with a first chain-like jewelry member 14*q*, and a second chain-like jewelry member 14*q"*, which both may be identical to the chain-like jewelry member 14*q* described above, and a third chain-like jewelry member 14, which may be identical to the chain-like jewelry member 14 described above in connection with FIGS. 1, 2, and 3, and the first chain-like jewelry member 14*q'* has its end links 32' and 34' bonded into the link receiving cavities 168 and 176, respectively, and the second chain-like jewelry member 14*q"* has its end links 32" and 34" bonded into the link receiving cavities 170 and 174, respectively, and the third chain-like jewelry member 14 has its end links 32 bonded into the link receiving cavity 172, all of the end links being bonded by a suitable adhesive in their respective link receiving cavities.

This concludes the description of the present invention. From the above it can be seen that not only is there provided a light weight article of jewelry, but also one which is comparatively inexpensive to fabricate and lends itself to mass production by utilizing readily available chain-like jewelry members for adornment. Further, the unique arrangement of the structural elements of the present invention allow a multiplicity of unique jewelry configurations utilizing the same basic structural components thereof.

Those skilled in the art will find many variations and adaptations of the present invention, and all such variations and adaptations are intended to be covered by the appended claims.

What is claimed is:

1. An improved jewelry arrangement, comprising, in combination:

a base means;

said base means having a back plate means having a first predetermined geometric configuration, and a side wall means comprising a plurality of side wall portions upstanding from said back plate means, and defining a generally "U" shape having an opening at one end thereof, and said side wall means having a second predetermined geometric configuration;

ear attaching means coupled to said back plate means and extending outwardly therefrom in a direction opposite said side wall means;

a first chain-like jewelry member, having a plurality of links, at least one end link and the next adjacent link thereto of said plurality of links each having a box-like structure means comprising a link back plate member and a link side wall member upstanding therefrom, and said link back plate member having said first predetermined geometric configuration, and said link side wall member having said second predetermined goemetric configuration;

said at least one end link coupled to said base means, and said link back plate of said one end link being adjacent said back plate means, and said link side wall of said one end link being adjacent said side wall means;

said chain-like jewelry member extending through said opening of said "U" shaped side wall means;

said back plate means of said bse means being adjacent at least a portion of said link back plate of said next adjacent link, and said side wall means of said base means being adjacent at least a portion of said link side wall of said next adjacent link;

and adhesive means for coupling said box-like structure means of said at least one end link to said base means, and at least a portion of said box-like structure means of said next adjacent link to said base means.

2. The arrangement defined in claim 1, wherein:

said first predetermined geometric configuration is a doubly curved configuration.

3. The arrangement defined in claim 1 or claim 3, wherein:

said second predetermined geometric configuration is a singly curved configuration.

4. The arrangement defined in claim 1 or claim 3, wherein:

said side wall means extend at substantially a right angle from said back plate means.

5. The arrangement defined in claim 1 wherein:

said first predetermined geometric configuration is planar; and said side wall means extend at substantially a right angle from said back plate means.

6. An improved jewelry arrangement, comprising, in combination:

a base means;

said base means having a back plate means having a first predetermined geometric configuration and side wall means comprising a plurality of side wall portions upstanding from said back plate means and having a second predetermined geometric configuration, and said side wall means and back plate means defining a plurality of link-receiving cavities, each of said link-receiving cavities having one end thereof open and the front thereof opposite said back plate open;

a first chain-like jewelry member having a plurality of links, and said chain-like jewelry member having a first end link and a first adjacent link thereto and a second end link, and a second adjacent link thereto, said first end link and said first adjacent link of said plurality of links each having a box-like structure means comprising a link back plate member and a link side wall member upstanding therefrom, and said link back plate having said first geometric configuration, and said link side wall member having said second predetermined geometric configuration, and said first end link member being coupled to said base means in a first of said plurality of link-receiving cavities, and said link back plate member of said first end link being adjacent said back means and said link side wall member of said first end link member being adjacent said side wall means;

said chain-link jewelry member extending through said open end of said first link-receiving cavity;

said back plate means of said first link-receiving cavity being adjacent at least a portion of said link back plate of said first adjacent link and said side wall portions of said first link-receiving cavity being adjacent at least a portion of said link side walls of said first adjacent link; and adhesive means for coupling said first end link and said first adjacent link to said base means.

7. The arrangement defined in claim 6, wherein:

said second end link and said second adjacent link are substantially identical to said first end link and said first adjacent link, respectively; and said second end link is positioned in a second of said plurality of link-receiving cavities;

said chain-link jewelry member extending through said open end of said second link-receiving cavity;

said back plate means of said second link-receiving cavity being adjacent at least a portion of said link back plate of said second adjacent link and said side wall portions of said second link-receiving cavity being adjacent at least a portion of said link side walls of said second adjacent link; and said adhesive means coupling said second end link and said second adjacent link to said base means in said second link-receiving cavity.

8. The arrangement defined in claim 6, wherein:

said plurality of link-receiving cavities are in a staggered relationship.

9. The arrangement defined in claim 8, wherein:

said staggered relationship is a step-staggered relationship.

10. The arrangement defined in claim 8, wherein:

said staggered relationship is a symmetrical-staggered relationship.

11. The arrangement defined in claim 6, wherein:

said plurality of said link-receiving cavities are in an aligned relationship.

12. The arrangement defined in claim 6, wherein:

the number of said plurality of link-receiving cavities is three;

and further comprising:

a second chain-like jewelry member substantially identical to said first chain-like jewelry member, and said second chain-like jewelry member having a plurality of links and a first end link and first adjacent link thereof substantially identical to said first end link and said first adjacent link, respectively, of said first chain-like jewelry member and said box-like structure means of said first end link of said second chain-like jewelry member coupled to said base means in the third of said link-receiving cavities, and said side wall portions of said third link-receiving cavity being adjacent at least a portion of said link side wall of said first adjacent link of said second chain-like jewelry member, and said back plate means of said third link-receiving cavity being adjacent at least a portion of said link back plate of said first adjacent link of said second chain-like jewelry member; and said adhesive means coupling said first end link and said first adjacent link of said second chain-like jewelry member to said base means in said third link-receiving cavity.

13. The arrangement defined in claim 6, wherein:

the number of said plurality of link-receiving cavities is five;

and further comprising:

a second chain-like jewelry member substantially identical to said first chain-like jewelry member, and said second chain-like jewelry member having a first end link and first adjacent link and a second end link and second adjacent link substantially identical to said first end link, said first adjacent link, said second end link and said second adjacent link of said first chain-like jewelry member, respectively, and said first end link and said first adjacent link of said second chain-like jewelry member being coupled to said base means in a third of said plurality of said link-receiving cavities, and said second end link and said second adjacent link of said second chain-like jewelry member being coupled to said base means in a fourth of said plurality of link-receiving cavities; and a third chain-like jewelry member substantially identical to said first and said second chain-like jewelry members, and said third chain-like jewelry member having a first end link and first adjacent link substantially identical to said first end link and said first adjacent link of said first chain-like jewelry member, respectively, and said first end link and said first adjacent link of said third chain-like jewelry member being coupled to said base means in the fifth link-receiving cavity; and said adjhesive means coupling said first and second end links and first and second adjacent links of said second chain-like jewelry member to said base means in said third and fourth link-receiving cavities, respectively, and said first end link and first adjacent link of said third chain-like jewelry member to said base means in said fifth link-receiving cavity.

* * * * *